US010352124B2

(12) United States Patent
Saraya

(10) Patent No.: US 10,352,124 B2
(45) Date of Patent: Jul. 16, 2019

(54) METHODS AND SYSTEMS FOR A BRIDGE PLUG

(71) Applicant: Vertice Oil Tools, Sugarland, TX (US)

(72) Inventor: Mohamed Saraya, SugarLand, TX (US)

(73) Assignee: Vertice Oil Tools, Sugarland, TX (US)

( * ) Notice: Subject to any disclaimer, the term of this patent is extended or adjusted under 35 U.S.C. 154(b) by 82 days.

(21) Appl. No.: 15/810,396

(22) Filed: Nov. 13, 2017

(65) Prior Publication Data

US 2019/0145219 A1 May 16, 2019

(51) Int. Cl.

| | |
|---|---|
| ***E21B 33/129*** | (2006.01) |
| ***E21B 34/06*** | (2006.01) |
| ***E21B 33/134*** | (2006.01) |
| ***E21B 33/128*** | (2006.01) |
| ***E21B 34/10*** | (2006.01) |
| ***E21B 34/14*** | (2006.01) |
| ***E21B 33/12*** | (2006.01) |
| ***E21B 33/126*** | (2006.01) |
| *E21B 34/00* | (2006.01) |

(52) U.S. Cl.

CPC ..... *E21B 33/129* (2013.01); *E21B 33/12* (2013.01); *E21B 33/126* (2013.01); *E21B 33/128* (2013.01); *E21B 33/1265* (2013.01); *E21B 33/1285* (2013.01); *E21B 33/134* (2013.01); *E21B 34/063* (2013.01); *E21B 34/102* (2013.01); *E21B 34/14* (2013.01); *E21B 33/1293* (2013.01); *E21B 2034/005* (2013.01)

(58) Field of Classification Search

CPC .... E21B 33/12; E21B 33/126; E21B 33/1265; E21B 33/128; E21B 33/129; E21B 33/134; E21B 2034/005; E21B 34/14

See application file for complete search history.

(56) References Cited

U.S. PATENT DOCUMENTS

| | | | | |
|---|---|---|---|---|
| 4,427,071 | A | 1/1984 | Carmody | |
| 4,674,575 | A | 6/1987 | Guess | |
| 5,246,069 | A * | 9/1993 | Glaser | E21B 17/14 166/153 |
| 6,328,062 | B1 | 11/2001 | Williams | |
| 2007/0095533 | A1 * | 5/2007 | Rogers | E21B 21/10 166/285 |
| 2008/0271883 | A1 | 6/2008 | Barton | |
| 2009/0159274 | A1 | 6/2009 | Frazier | |
| 2013/0341050 | A1 | 12/2013 | Biddick | |
| 2014/0124212 | A1 | 8/2014 | Slup | |
| 2015/0247375 | A1 | 9/2015 | Stout | |
| 2016/0194932 | A1 | 7/2016 | Liu | |

* cited by examiner

*Primary Examiner* — D. Andrews
*Assistant Examiner* — Tara E Schimpf
(74) *Attorney, Agent, or Firm* — Pierson IP, PLLC

(57) ABSTRACT

Example of the present disclosure relate to a bridge plug. More specifically, embodiments are directed towards a bridge plug with a flapper, wherein the flapper is configured to set and unset based on a pressure differential and/or fluid flow associated with the bridge plug.

22 Claims, 6 Drawing Sheets

METHODS AND SYSTEMS FOR A BRIDGE PLUG

BACKGROUND INFORMATION

Field of the Disclosure

Example of the present disclosure relate to a bridge plug. More specifically, embodiments are directed towards a bridge plug with a moveable flapper or disc (referred to hereinafter collectively and individually as "flapper")), wherein the moveable flapper is configured to set and unset based on a pressure differential and/or a direction of fluid flow associated with the bridge plug.

Background

A bridge plug is a tool that is set downhole to isolate portions of a wellbore. Bridge plugs are typically set by pumping it using a driving fluid through the wellbore. Once in place, the bridge plug may be set. Setting the bridge plug may include expanding slips or seals for anchoring and sealing of the bridge plug, respectively. Once anchored and sealed, a perforation application may take place above the bridge plug, so as to provide perforations through the casing in the isolated section of the wellbore above the bridge plug. This process is then completed multiple times with different bridge plugs from the toe to the heel of the well until the casing and formation have been configured and repeated as desired.

Unfortunately, unlike setting of the bridge plug, it is difficult to remove a bridge plug from a wellbore. As a result, removal of a bridge plug requires drilling out the bridge plug from the wellbore. In horizontal sections of a well, this task can be rather difficult. Furthermore, unlike the initial positioning of the bridge plug, conventional bridge plugs are either plugged which prohibit the ability to re-pump another plug in case the communication perforation cannot be established above, or it requires a drop and pumping of a ball at the top of the plug which consume excessive amount of fluid.

Further during milling of bridge plugs and once the slips are milled, the bottom parts of the bridge plug can't be further milled due to spinning. While spinning, the bridge plug is pushed down to a lower plug and more weight is exerted on it to allow milling before milling the lower plug. However, this method consumes time.

Accordingly, needs exist for system and methods utilizing a bridge plug with a flapper, wherein the flapper is configured to set and unset based on a pressure differential and/or fluid flow associated with the bridge plug, and where the flapper seat can be removed using pressure differential in case of failure of achieving perforation above the flapper. In embodiments, removal of the flapper seat may establish communication with perforation below the bridge plug, and allow either a ball to be dropped within the wellbore or another bridge plugged to be pumped.

Also a need exist to create a method by which the bottom of each bridge plug can latch with the top of the next plug to prevent rotation and create a locking by which milling can be conducted in an easier way.

SUMMARY

Embodiments disclosed herein describe a bridge plug with a movable flapper, wherein the flapper is configured to close based on a pressure differential and/or fluid flow from a proximal end towards a distal end of the bridge plug, and the flapper is configured to open based on the pressure and/or fluid flow from the distal end towards the proximal end of the bridge plug.

The bridge plug may include an outer mandrel, an inner mandrel, and a movable flapper.

The outer mandrel may be configured to be positioned outside and adjacent to the inner mandrel, wherein the outer mandrel and the inner mandrel may be coupled together via threads and/or shear screws. The outer mandrel may include a pump down element, expandable members, and slips.

The pump down element may be a device that is configured to extend away from the outer circumference of the outer mandrel, and receive fluid flow between a casing and the outer mandrel. The pump down element may have a force acted upon it by the flowing fluid through an annulus, which may be utilized to move the bridge plug towards a distal end of the wellbore.

The expandable members may be sealing elements that are configured to be set to extend across an annulus between the outer mandrel and the casing. The expandable members may be configured to compress and extend across the annulus responsive to the outer mandrel being positioned at a desired location and/or based on a fluid flow rate through the annulus. Responsive to the expandable members being set, the bridge plug may be set in place.

The slips may be configured to couple the bridge plug with a casing and/or other elements to limit the rotation and axial movement of the bridge plug during milling. The slips may be configured to compress and radially expand.

The inner mandrel may be a hollow chamber that is positioned adjacent to, and within the outer mandrel. The inner mandrel may be configured to house a flapper seat, a hinge, and the moveable flapper.

The flapper seat may be configured to receive the moveable flapper when the moveable flapper is positioned in a first mode, wherein in the first mode the moveable flapper closes the hollow chamber.

The hinge may be a mechanical bearing or a torsion spring that is configured to couple the inner mandrel and the moveable flapper, and allow the moveable flapper to rotate. In embodiments, the hinge may provide a force against the moveable flapper that retains the moveable flapper in a first mode if no other forces are applied to the movable flapper, while assisting the moveable flapper to move from the first mode to the second mode if fluid flows in the inner mandrel from the distal end towards the proximal end.

The moveable flapper may be a seal, stopper, wall, disc etc. that is configured to move between a first mode and a second mode. In the first mode, the moveable flapper may be configured to seal a distal end of the bridge plug. In the second mode, the moveable flapper may be configured to allow the flow of fluid from the distal end of the bridge plug towards the proximal end of the bridge plug.

In embodiments, the proximal end of a first bridge plug may include a first locking profile, and a distal end of the first bridge plug may include a second locking profile. The second locking profile may be configured to mate with a first locking profile of a subsequent bridge plug in the wellbore. The locking profiles may mate based on rotational forces and/or linear forces. Responsive to mating the locking profiles, the first bridge plug may be rotationally locked, which may enable more efficient milling, drilling, etc.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
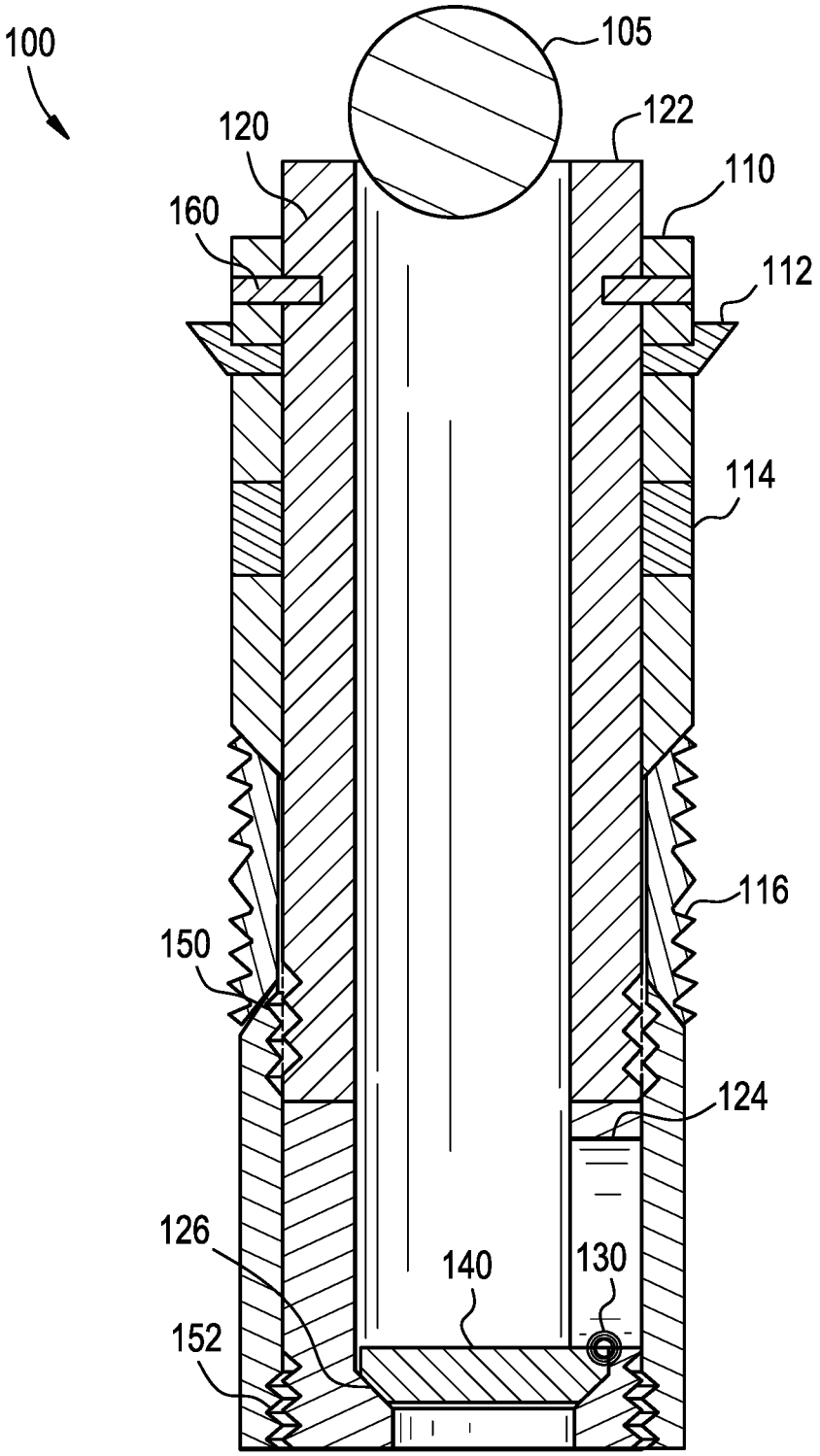
FIG. 1 depicts a bridge plug, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a bridge plug 100, according to an embodiment. Bridge plug 100 may be configured to selectively seal a distal end of bridge plug 100 to increase pressure within a wellbore based on a direction of fluid flowing through the bridge plug, wherein bridge plug 100 may operate with or without additional elements such as frac ball 105. Bridge plug 100 may be comprised of any desired material or a combination of different materials, such as steel, composite, etc. Bridge plug 100 may include an outer mandrel 110, inner mandrel 120, hinge 130, and movable flapper 140.

Outer mandrel 110 may be configured to be positioned outside and adjacent to inner mandrel 120, wherein outer mandrel 110 and inner mandrel 120 may be coupled together via threads 150, 152 and/or shear screws 160. Threads 150, 152 may be configured to couple the mandrels together, and provide anti-rotation segments for milling. The threads 150, 152 may be positioned above and/or below moveable flapper 140, which may assist in the providing anti-rotation segments of bridge plug 100 for milling. Shear screws 160 may be configured to decouple outer mandrel 110 and inner mandrel 120 based on a pressure and/or fluid flow rate. Responsive to the pressure and/or fluid flow rate in an annulus between bridge plug 100 and a casing increasing past a threshold, the shear screws 160 may break. This may allow outer mandrel 110 to compress.

Outer mandrel 110 may include a pump down elements 112, expandable members 114, and slips 116.

Pump down elements 112 may be devices that are configured to extend away from the outer circumference of outer mandrel 110, and receive fluid flowing between a casing and outer mandrel 110. In embodiments, pump down elements 112 may be shaped as cups, vessels, etc. wherein the force of fluid flowing towards a distal end of the wellbore impacts outer mandrel 110 to move bridge plug 100 towards a distal end of the wellbore. Accordingly, responsive to flowing fluid through an annulus between outer mandrel 110 and the casing, pump down elements 112 may pull bridge plug 100 towards the distal end of the wellbore. However, the shaping of pump down elements 112 may allow fluid flowing towards the proximal end of the wellbore through the annulus between outer mandrel 110 and the casing to not create sufficient force to move outer mandrel 110 towards the proximal end of the wellbore.

Expandable members 114 may be sealing elements that are configured to be set to extend across an annulus between outer mandrel 110 and the casing. Expandable members 114 may be configured to compress and extend across the annulus responsive to outer mandrel 110 being positioned at a desired location and moving relative to inner mandrel 120 and/or based on a fluid flow rate through the annulus. Responsive to setting expandable members 114, bridge plug 100 may be set in place.

Slips 116 may be configured to couple bridge plug 116 with a casing and/or other elements. This may lock bridge plug 100 in place, and also limit the rotation of bridge plug 116 during milling. In embodiments, slips 116 may be configured to radially expand to fix outer mandrel 110 in place, or slips 116 may be milled to decrease the length of outer mandrel 110. The slips may be formed of any type of materials, such as composite, metals, carbide, etc.

Inner mandrel 120 may be positioned adjacent to and within outer mandrel 110. Inner mandrel 120 may have a length that is longer than that of outer mandrel 110. A proximal end of inner mandrel 120 projects away from a proximal end of outer mandrel 110, such that the proximal ends are not flush. Inner mandrel 120 may include a ball seat 122, indentation 124, flapper seat 126.

Ball seat 122 may be positioned on a proximal end of inner mandrel 120. Ball seat 122 may be configured to house a frac ball 105 that is dropped within the wellbore. Ball seat 122 may limit the downward movement of frac ball 105, which may allow pressure to build within the wellbore in a position above frac ball 105.

Indentation 124 may be a depression, notch, cutout, etc. positioned within a sidewall of inner mandrel 120. Indentation 124 may be configured to house moveable flapper 140 when moveable flapper 140 is in the second position. While in the second position, a first end of moveable flapper may be substantially flush with an inner diameter of inner mandrel 120, such that fluid may flow through a hollow chamber through bridge plug 100.

Flapper seat 126 may be positioned below a distal end of indentation 124. Flapper seat 126 may be any type of device that is configured to secure and house moveable flapper 140 while moveable flapper is in a first position. Furthermore, flapper seat 126 may be configured to limit the rotation of moveable flapper 140, such that a second end of moveable flapper 140 is positioned in a direction to allow flow in the direction of the axis of bridge plug 100. In embodiments, flapper seat 126 may include a tapered, angled, sloped, etc. circumference that is configured to decrease the inner diameter of inner mandrel 120 from the first end of flapper seat 126 to a second end of flapper seat 126. The changing of diameter may allow moveable flapper 140 to be positioned on flapper seat 126 in the second mode, and form a seal across the inner diameter of inner mandrel 120. Flapper seat 126 may be coupled to bridge plug at any location between the proximal and distal ends of bridge plug 100 via a plurality of different mechanisms, such as threads, shearing devices, etc. In embodiments, where flapper seat 126 is selectively coupled to bridge plug 100 via shearing devices, flapper seat 126 may be decoupled from bridge plug 100. Flapper seat 126 may be decoupled from bridge plug 100 based on a pressure applied to flapper seat 126 from fluid flowing from the proximal end to the distal end of bridge plug 100. Once the pressure applied is above a shearing threshold, flapper seat 126 may be decoupled from bridge plug 100, and allow for communication with zones below bridge plug 100. If it is desired to seal bridge plug 100 without the use of moveable flapper 140, frac ball may positioned on the proximal end of inner mandrel 120 to create a seal across the inner diameter of bridge plug 100.

Hinge 130 may be a mechanical bearing or a torsion spring that is configured to couple inner mandrel 120 and moveable flapper 140, and allow moveable flapper 140 to rotate. In embodiments, hinge 130 may provide a force against moveable flapper 140 that retains moveable flapper 140 in a first mode if no other forces are applied to moveable flapper 140, while assisting moveable flapper 140 to move from the first mode to the second mode if fluid flows in the inner mandrel 110 from the distal end towards the proximal end of bridge plug 100.

Moveable flapper 140 may be a seal, stopper, wall, etc. that is configured to move between a first mode and a second mode. In the first mode, moveable flapper 140 may be configured to seal a distal end of bridge plug 100 when seated on flapper seat 126. In the second mode, moveable flapper 140 may be positioned with indentation and be configured to allow the flow of fluid from the distal end of bridge plug towards the proximal end of bridge plug 100. In embodiments, moveable flapper 140 may be any type of device that is has a diameter that is smaller than that of a first end of flapper seat 126 but is larger than that of a second end of flapper seat 126, such that moveable flapper 140 may form a seal within bridge plug at a location aligned with flapper seat 126. For example, in embodiments, moveable flapper 140 may be disc shaped or half ball shaped and may not be coupled to inner mandrel 120 via hinge 130. However, in other embodiments, moveable flapper 140 may be a butterfly flapper with either one or two independent parts that each have first ends coupled to inner mandrel 110 at opposite sides of flapper seat 126, and when in the first mode the second ends of the independent parts are overlaid over each other to form a seal.

The material of the bridge plug components can be made of any material, including, cast iron, composite, dissolvable or steel, further, more than one material can be used to build the components of the bridge plug.

Figure 2:
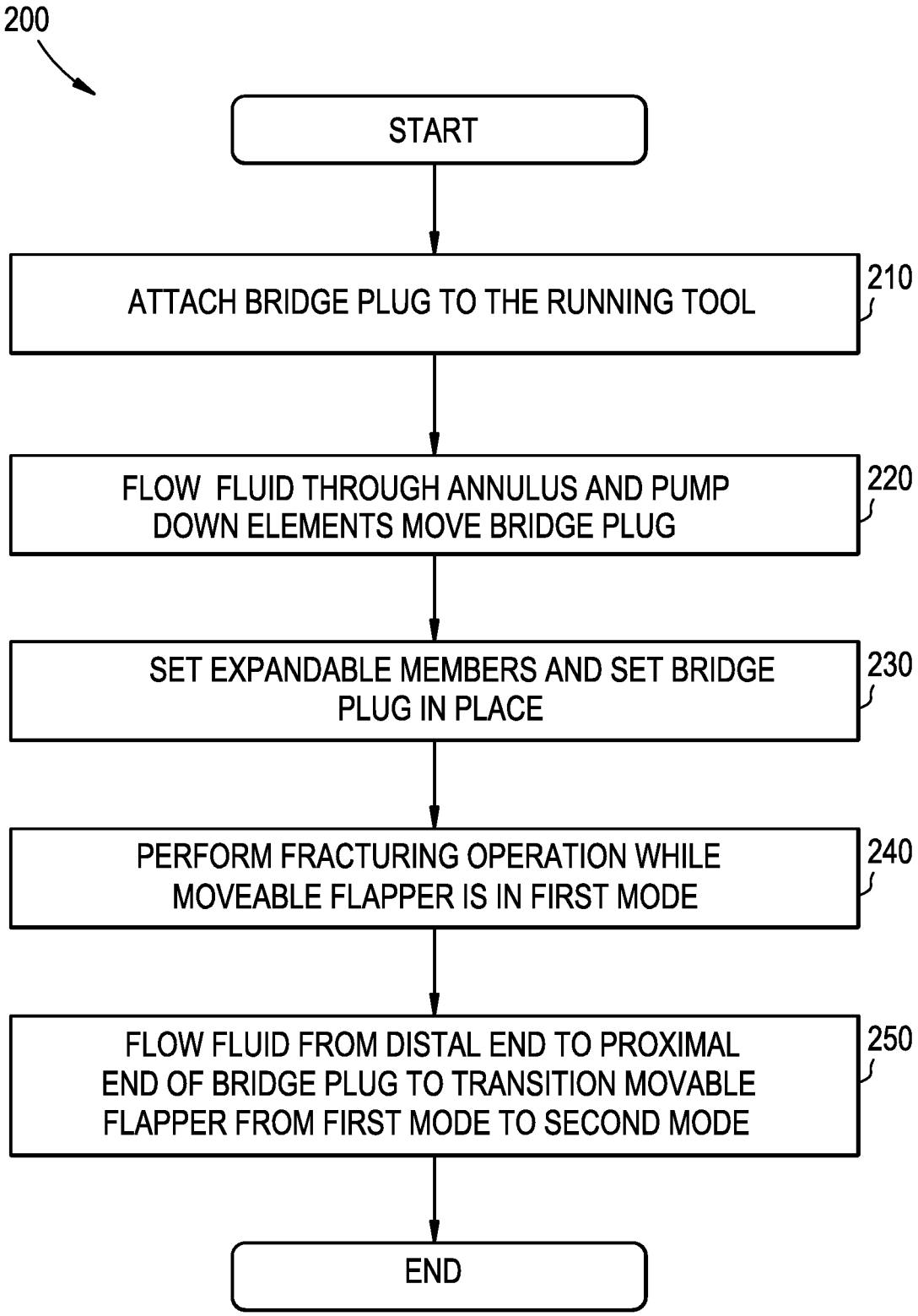
FIG. 2 depicts a method of using a bridge plug, according to an embodiment.

FIG. 2 depicts a method 200 for stimulating a well. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting. Furthermore, the operations of method 200 may be repeated for subsequent valves or zones in a well.

At operation 210, an inner mandrel may be coupled to an outer mandrel forming the bridge plug which then can be coupled to a running tool. The mandrels may be coupled together using threads, shear screws, etc.

At operation 220, fluid may flow through an annulus positioned outside the outer mandrel, wherein the fluid interacts with pump down elements. Responsive to the fluid interacting with the pump down elements, the pump down elements may pull the inner mandrel and the outer mandrel towards a distal end of the wellbore. In embodiments, while the bridge plug is being pulled down, a moveable flapper may be in a first mode, wherein in the first mode the moveable flapper creates a seal across a distal end of the inner mandrel.

At operation 230, responsive to pulling the bridge plug down to a desired location, expandable members may be set and extend across the annulus.

At operation 240, while the moveable flapper is in the first mode, creating a seal, fluid may be pumped into a hollow chamber within the inner mandrel. The fluid may be pumped at a desired flow rate such that the pressure within the wellbore above the moveable flapper increases past a threshold to perform a fracturing operation.

At operation 250, fluid may flow from a position below the moveable flapper towards the proximal end of the bridge plug. This fluid flow may be sufficient to overcome a spring force to move the moveable flapper from the first mode to a second mode, wherein in the second mode the moveable flapper is positioned in an axis in parallel to the longitudinal axis of the bridge plug. Furthermore, while the moveable flapper is in the second mode, a seal may not be formed through the inner mandrel.

Figure 3:
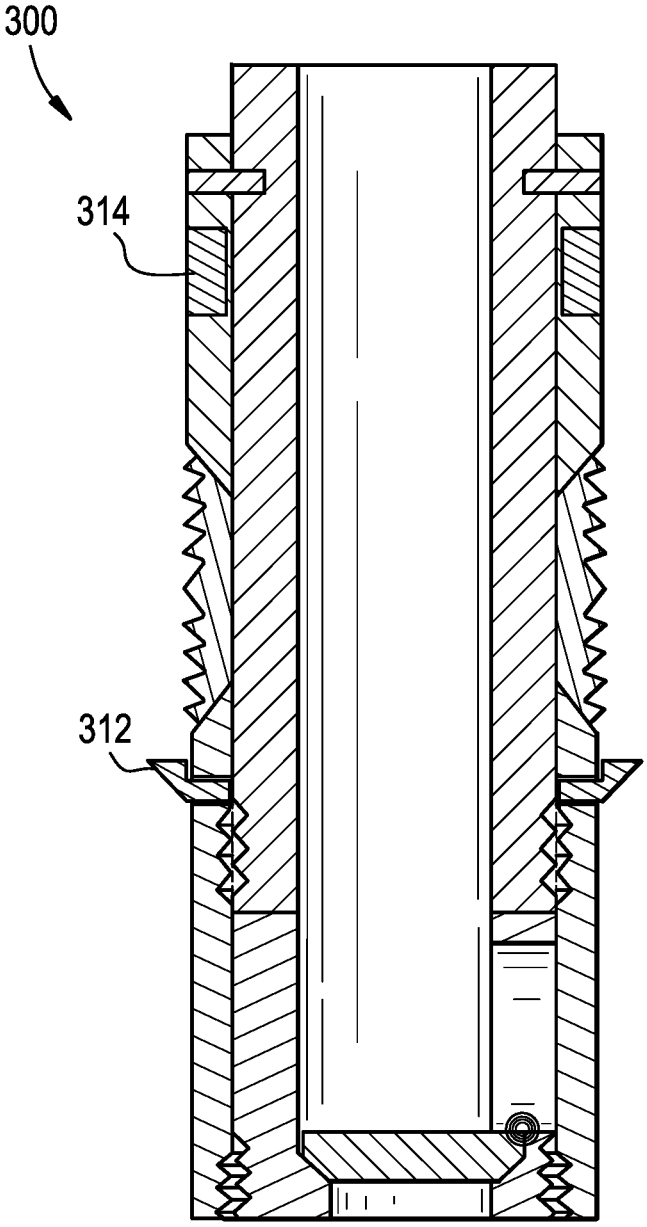
FIG. 3 depicts a bridge plug, according to an embodiment.

FIG. 3 depicts a bridge plug 300, according to an embodiment. Elements depicted in FIG. 3 may be discussed above. For the sake of brevity, another description of these elements is omitted.

As depicted in FIG. 3, pull down elements 312 may be positioned close to a distal end of bridge plug than expandable elements 314.

Figure 4:
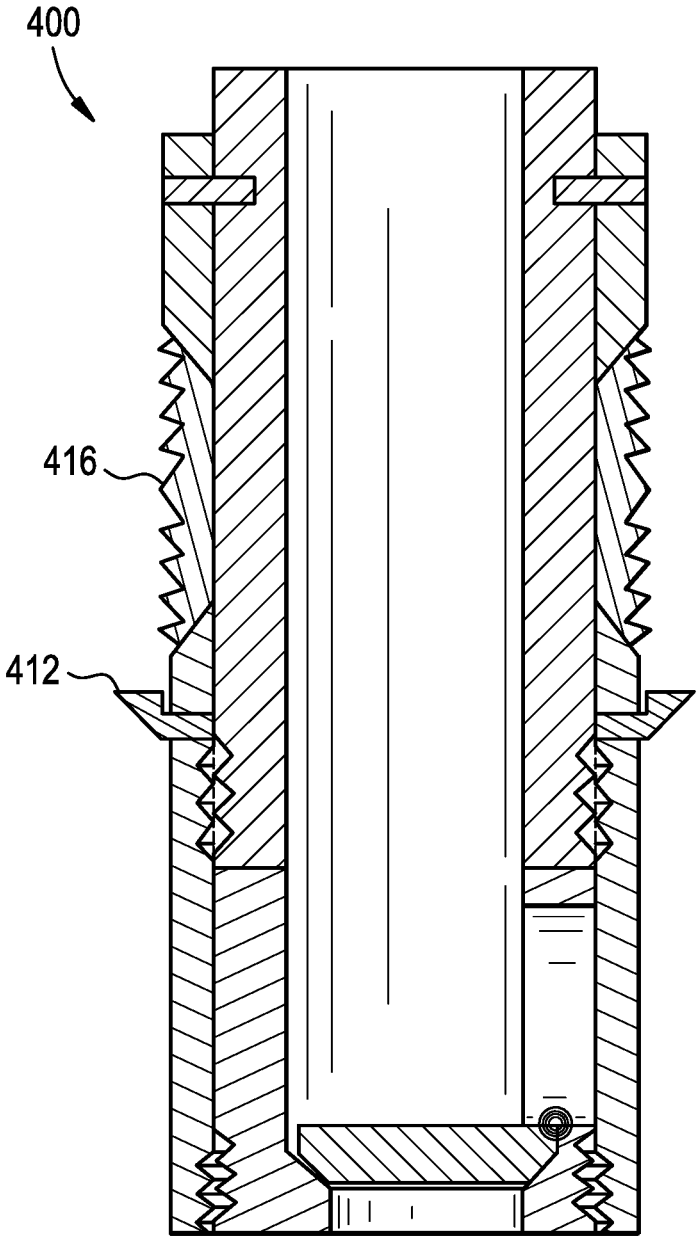
FIG. 4 depicts a bridge plug, according to an embodiment.

FIG. 4 depicts a bridge plug 400, according to an embodiment. Elements depicted in FIG. 4 may be discussed above. For the sake of brevity, another description of these elements is omitted.

As depicted in FIG. 4, bridge plug 400 may not include expandable elements. Bridge plug 400 may be configured to couple with the casing by compressing and expanding slips 416 across an annulus. By removing expandable elements, a length of bridge plug 400 may decrease.

Figure 5:
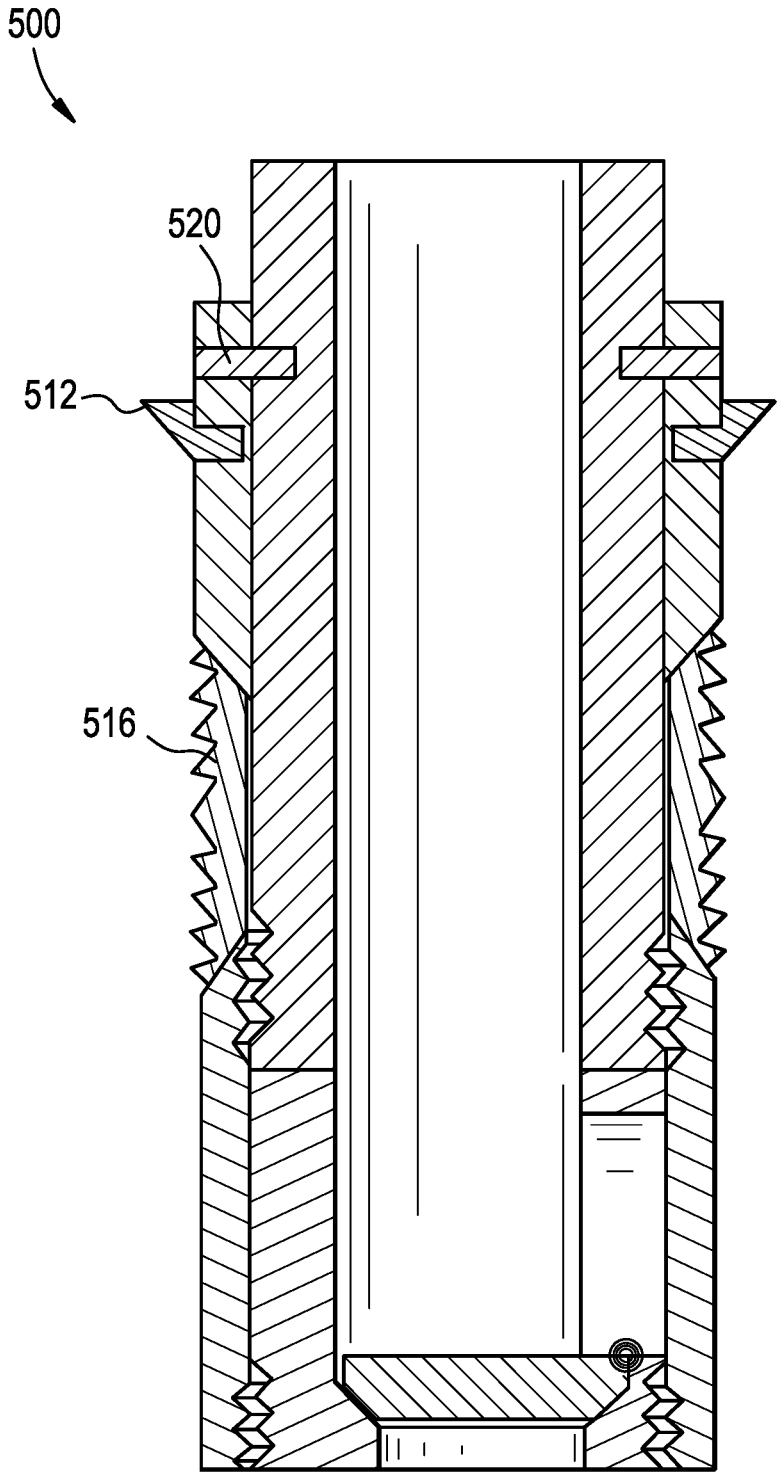
FIG. 5 depicts a bridge plug, according to an embodiment.

FIG. 5 depicts a bridge plug 500, according to an embodiment. Elements depicted in FIG. 5 may be discussed above. For the sake of brevity, another description of these elements is omitted.

As depicted in FIG. 5, slips 516 may be positioned below pull down elements 512. Responsive to a force acting upon pull down elements 512 being greater than that of shear screws 520, pull down elements 512 may impact a force on slips 512 to radially expand slips.

Figure 6:
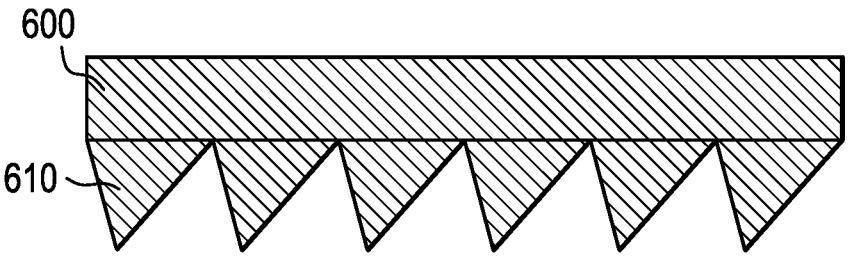
FIG. 6 depicts a first locking mechanism, according to an embodiment.

FIG. 6 depicts a first locking mechanism 600, according to an embodiment. First locking mechanism 600 may be configured to be positioned on proximal ends of bridge plugs 100 within a wellbore. First locking mechanism 600 may include a plurality of first teeth, threads, projections 610 with corresponding grooves.

Figure 7:
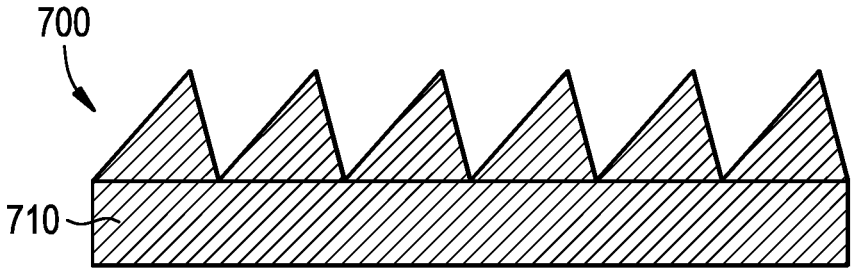
FIG. 7 depicts a second locking mechanism, according to an embodiment.

FIG. 7 depicts a second locking mechanism 700, according to an embodiment. Second locking mechanism 700 may be configured to be positioned on distal ends of bridge plugs 100 within the wellbore. Second locking mechanism 700 may include a plurality of second teeth, threads, projections 710 with corresponding grooves.

In embodiments, first projections 610 may be positioned on the outer circumference of an inner mandrel of a first bridge plug, and second projection may be positioned on an inner circumference of an outer mandrel of a subsequent bridge plug. This may allow the projections to face each other while interfaced.

Figure 8:
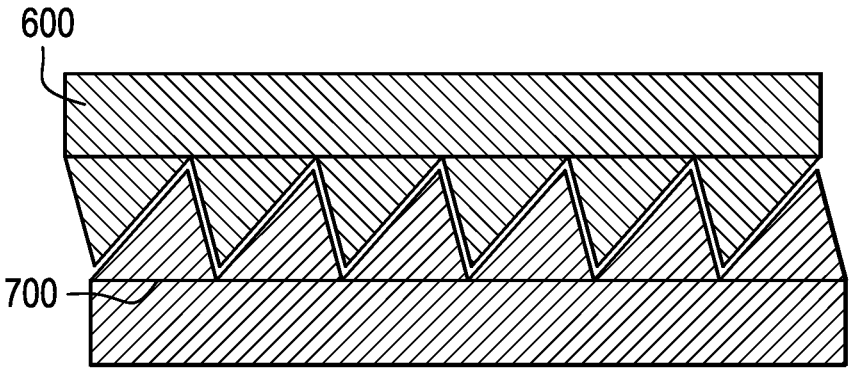
FIG. 8 depicts a first locking mechanism interfaced with a second locking mechanism, according to an embodiment.

FIG. 8 depicts second locking mechanism 700 associated with a first bridge plug interfacing with first locking mechanism 600 of a subsequent bridge plug. In embodiments, as the first bridge plug is milled, drilled, etc. the first bridge plug may be pushed downhole towards the subsequent bridge plug. This may interface second projections 710 associated with second locking mechanism 700 with first projections 610 associated with first locking mechanism 600. When interfaced together, the first bridge plug and the second bridge plug may be rotationally locked. This may allow for easier and more effective milling of the first bridge plug and the subsequent bridge plug.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A bridge plug comprising:

an outer mandrel;

slips positioned on an outer circumference of the outer mandrel, the slips being configured to couple the bridge plug to casing;

an inner mandrel coupling to the outer mandrel; and a movable flapper being coupled to the inner mandrel or the outer mandrel, the moveable flapper valve configured to move between an open mode and a closed mode, wherein in the closed mode the moveable flapper creates a seal across a distal end of the inner mandrel, wherein forces applied by fluid flowing from the distal end of a wellbore to the proximal end of the wellbore against the moveable flapper moves the moveable flapper from the closed mode to the open mode.

2. The bridge plug of claim 1, wherein further comprising:

a flapper seat configured to receive the moveable flapper when the moveable flapper is in the closed mode.

3. The bridge plug of claim 2, wherein the bridge plug further comprises:

an indentation configured to receive the moveable flapper when the moveable flapper is in the open mode.

4. The bridge plug of claim 2, wherein the flapper seat is shearable from the bridge plug, the flapper seat including tapered sidewalls that decrease the inner diameter of the inner mandrel.

5. A bridge plug of claim 4, wherein the inner mandrel further comprises:

a spring configured to couple the moveable flapper and the inner mandrel, the spring applying a torsion force against the moveable flapper to retain the moveable flapper in a pre-determined mode, wherein the moveable flapper is sheared when the flapper seat is sheared.

6. The bridge plug of claim 5, wherein a proximal end of the bridge plug includes a ball profile configured to receive a frac ball.

7. The bridge plug of claim 4, wherein a torsion force is overcome by flowing fluid from a distal end of the inner mandrel towards a proximal end of the inner mandrel.

8. The bridge plug of claim 1, wherein the outer mandrel includes:

pull down elements configured to receive fluid flowing through an annulus between the outer mandrel and casing, wherein fluid interacts with the pull down elements to create a force to move the bridge plug within the wellbore.

9. The bridge plug of claim 8, further comprising:

an expandable member positioned on the outer mandrel, wherein the pull down elements are positioned closer to a proximal end of the outer mandrel than the expandable member.

10. The bridge plug of claim 8, further comprising:

an expandable member positioned on the outer mandrel, wherein the pull down elements are positioned closer to a distal end of the outer mandrel than the expandable member.

11. The bridge plug of claim 1, wherein a first locking mechanism is positioned on a proximal end of the bridge plug; and a second locking mechanism is position on a distal end of the bridge plug, the first locking mechanism and the second locking mechanism being configured to rotationally lock the bridge plug.

12. A method associated with a bridge plug comprising:

coupling an outer mandrel with an inner mandrel;

coupling a moveable flapper to the inner mandrel or the outer mandrel;

moving the moveable flapper between an open mode and a closed mode;

creating a seal when the moveable flapper is in the closed mode;

expanding slips positioned on an outer circumference of the outer mandrel to couple the bridge plug with casing;

flowing fluid from the distal end of a wellbore towards the proximal end of the wellbore; and moving, by the flowing fluid, the moveable flapper from the closed mode to the open mode.

13. The method of claim 12, further comprising:

creating the seal across the inner mandrel by positioning the moveable flapper within a flapper seat when the moveable flapper is in the closed mode.

14. The method of claim 13, further comprising:

positioning the moveable flapper within an indentation within the bridge plug when the moveable flapper is in the open mode.

15. The method of claim 13, further comprising:

shearing the flapper seat from the bridge plug, the flapper seat including tapered sidewalls that decrease the inner diameter of the inner mandrel.

16. The method of claim 15, further comprising:

coupling the moveable flapper to the inner mandrel via a spring;

applying a torsion force against the moveable flapper by the spring to retain the moveable flapper in a pre-determined mode; and shearing the moveable flapper when shearing the flapper seat.

17. The method of claim 16, further comprising:

overcoming the torsion force flowing fluid from a distal end of the inner mandrel towards a proximal end of the inner mandrel.

18. The method of claim 16 further comprising:

positioning a frac ball on a ball seat located at a proximal end of the inner mandrel.

19. The method of claim 12, further comprising:

pumping fluid through an annulus between the outer mandrel and casing;

creating a force on pull down elements via the fluid flowing through an annulus between the outer mandrel and casing; and moving the bridge plug within the wellbore based on the created force.

20. The method of claim 19, further comprising:

positioning the pull down elements closer to a proximal end of the outer mandrel than an expandable member, wherein the expandable member is positioned on the outer mandrel.

21. The method of claim 19, further comprising:

positioning the pull down elements closer to a distal end of the outer mandrel than an expandable member, wherein the expandable member is positioned on the outer mandrel.

22. The method of claim 12, further comprising:

interfacing a first locking mechanism positioned on a proximal end of a subsequent bridge plug with a second locking mechanism positioned on a distal end of the bridge plug; and rotationally locking the bridge plug and the subsequent bridge plug responsive to interfacing the first locking mechanism and the second locking mechanism.

* * * * *